US011208308B1

(12) United States Patent
Pearce

(10) Patent No.: US 11,208,308 B1
(45) Date of Patent: Dec. 28, 2021

(54) LOAD STABILIZATION DEVICE

(71) Applicant: Chase Pearce, Okeechobee, FL (US)

(72) Inventor: Chase Pearce, Okeechobee, FL (US)

( * ) Notice: Subject to any disclaimer, the term of this patent is extended or adjusted under 35 U.S.C. 154(b) by 189 days.

(21) Appl. No.: 16/533,943

(22) Filed: Aug. 7, 2019

(51) Int. Cl.
*B66F 9/12* (2006.01)
*B66F 9/18* (2006.01)

(52) U.S. Cl.
CPC . *B66F 9/12* (2013.01); *B66F 9/18* (2013.01)

(58) Field of Classification Search
CPC ..... B66F 9/12; B66F 9/18
See application file for complete search history.

(56) References Cited

U.S. PATENT DOCUMENTS 3,797,672 A 3/1974 Vermette
3,826,334 A 7/1974 Spillman
4,390,080 A 6/1983 Bushnell, Jr.
5,555,953 A 9/1996 Henderson
8,910,749 B1 12/2014 Jensen
2008/0230312 A1 9/2008 Van Havermaet
2015/0071715 A1* 3/2015 Hammer ..... E02D 29/0233 405/286
2016/0273678 A1* 9/2016 Gathman ..... B66F 9/18
2017/0334644 A1* 11/2017 Otto ..... B65G 1/0492
2018/0154789 A1* 6/2018 Janku ..... B60L 50/64
2018/0370779 A1* 12/2018 Ivey ..... B66F 9/19
2019/0053433 A1* 2/2019 Borchers ..... A01D 87/127
2019/0100421 A1* 4/2019 Reedy ..... B65D 19/0095
2019/0315611 A1* 10/2019 Calomino ..... B66F 9/10
2019/0330812 A1* 10/2019 Ptacek ..... E01F 13/022
2020/0079630 A1* 3/2020 Mattern ..... B66F 9/122
2020/0207597 A1* 7/2020 Goncalves ..... B66F 5/02
2020/0346908 A1* 11/2020 Macalus ..... B66F 9/18
2020/0391986 A1* 12/2020 Picha ..... B66F 7/025

* cited by examiner

*Primary Examiner* — Saul Rodriguez
*Assistant Examiner* — Ashley K Romano
(74) *Attorney, Agent, or Firm* — Cramer Patent & Design, PLLC; Aaron R. Cramer

(57) ABSTRACT

An extension system for a bucket tractor includes a boom and a scaffold removably secured to a base configured to be supported with a bucket of a tractor.

13 Claims, 6 Drawing Sheets

LOAD STABILIZATION DEVICE

RELATED APPLICATIONS

Not applicable.

FIELD OF THE INVENTION

The present invention relates to a load stabilization device.

BACKGROUND OF THE INVENTION

Skid steer loaders are very handy vehicles commonly used around farms, nurseries, construction sites, and for general landscaping and maintenance. Their small size and maneuverability allow them to operate in tight spaces. Their light weight allows them to be towed behind a full-size pickup truck, and the wide array of attachable accessories makes them very flexible. They can even be equipped with forks to help lift palleted material or other large heavy loads. However, such forks are not the best at trying to stabilize long loads that extend over the forks by a significant amount.

Against manufacturer's instructions, many people try to keep such loads, such as metal roofing, perfectly balanced, but if any wind should come along or a part of load removed thus unbalancing the forks, disaster is often the result. Accordingly, there exists a need for a means by which a by which skid steers with forks or forklift themselves can be adapted to easily and safely lift long loads. The development of the Extension Boom for Bucket of Tractor fulfills this need.

SUMMARY OF THE INVENTION

The inventor has recognized the aforementioned, inherent problems and lack in the art and observed that there is a need for a load stabilization device, comprising a base assembly which has a base platform with a pair of fork receiving cavities capable of receiving a pair of forks. The base assembly is disposed at a proximal end of the load stabilization device. The load stabilization device also comprises a first longitudinal member which extends away from the base assembly from which a pair of first restraining members are placed and a second longitudinal member which linearly extends away from the first longitudinal member from which a pair of first restraining members are placed. The second longitudinal member slidably engages the first longitudinal member and is secured thereto. The load stabilization device also comprises a plurality of linear loads carried, transported and supported by the load stabilization device. The pair of first restraining members are attached to the side surfaces of the longitudinal members to serve as structural support for the linear loads.

The load stabilization device may further comprise a set of four structural side panels which form a pyramid shape which centers an upper panel at the midpoint to ensure a central based center of gravity between the pair of fork receiving cavities. The pair of first restraining members may be replaced with a single second restraining member. The single second restraining member may be affixed to the distal end of the first longitudinal member. The single second restraining member may be a shelf with a bottom wall, a rear wall, and a pair of side walls. The second longitudinal member slidably engages the first longitudinal member via a securing pin routed through an aligned pairs of apertures. The first longitudinal member is between twelve feet to twenty feet. The second longitudinal member is between twelve feet to twenty feet. The load stabilization device may also comprise a hook located on a distal end of the second longitudinal member for grasping objects therewith. The hook may be located on a distal end of the first longitudinal member for grasping objects therewith or the hook may be located on a distal end of the first restraining member for grasping objects therewith. The linear loads may be a plurality of flat panels which may be selected from the group consisting of a plurality of roofing panels, a plurality of siding panels, and a plurality of dimensional lumber.

The linear loads may be a plurality of cylindrical objects selected from the group consisting of a plurality of pipe, a plurality of conduit, and a plurality of rebar. The load stabilization device may further comprise a plurality of lashing members used to secure the linear loads to the first restraining members. The lashing members may be selected from the group consisting of a plurality of ropes, a plurality of ratcheting clamps, or a plurality of bungee cords. The load stabilization device may be made of steel for strength or have a protective paint finish to prevent corrosion, or a protective plating finish to prevent corrosion. The load stabilization device may be installed on a skid steer machine or on a forked lifting device.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
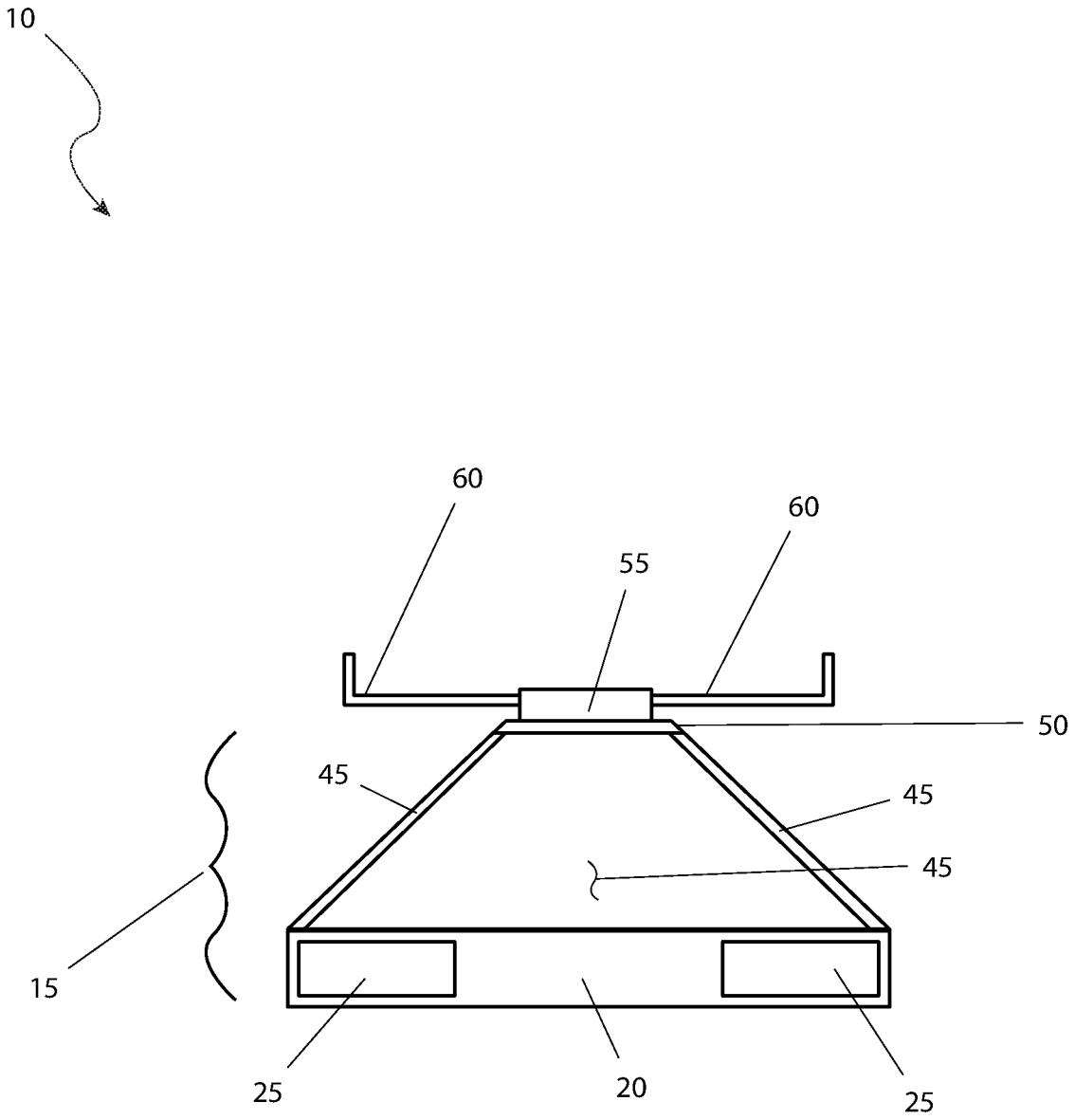
FIG. 1 is an end view of the load stabilization device 10 for forked lifting machines 40, according to the preferred embodiment of the present invention.

10 load stabilization device
15 base assembly
20 base platform
25 fork receiving cavity
30 fork
35 skid steer machine
40 forked lifting deice
45 structural side panel
50 upper panel
55 first longitudinal member
56 aperture
57 securing pin

59 second longitudinal member
60 first restraining member
61 second restraining member
62 hook
65 linear load
70 flat panel
75 cylindrical object
80 lashing member
85 fork lift accessory
90 operator
95 field of view
100 unloading point
105 user
110 sliding path "a"
115 elevated work location

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, an end view of the load stabilization device 10 for forked lifting machines 40, according to the preferred embodiment of the present invention is disclosed. The load stabilization device (herein also described as the "device") 10, includes a base assembly 15 at the proximal end of the device 10. The base assembly 15 has a base platform 20 with two (2) fork receiving cavities 25, capable of receiving forks 30 (not shown in this FIGURE) from a skid steer machine 35 (not shown in this FIGURE), a forklift 40 (not shown in this FIGURE), or similar machine. A set of four (4) structural side panels 45 (of which only three (3) are depicted in FIG. 1) due to illustrative limitations) form a pyramid shape which centers an upper panel 50 at the midpoint. Such centering ensures a central based center of gravity between the two (2) fork receiving cavities 25. A first longitudinal member 55 then extends away from the base assembly 15, from which two (2) first restraining members 60 are placed. A second longitudinal member linearly extends away from the first longitudinal member 55, also from which two (2) first restraining members 60 are placed. Further description of the arrangement between the base assembly 15 and the longitudinal members 55, 59 will be provided herein below.

It is envisioned that all components of the device 10 would be made of steel for strength. Various shapes such as steel tubes, steel plates and the like would be cut to size and welded together. Should large scale production of the present invention be undertaken, suitable jigs and other assembly aids would be needed to speed production and ensure consistency. After manufacture, a suitable protective finish such as paint or plating would be applied to prevent corrosion.

Figure 2:
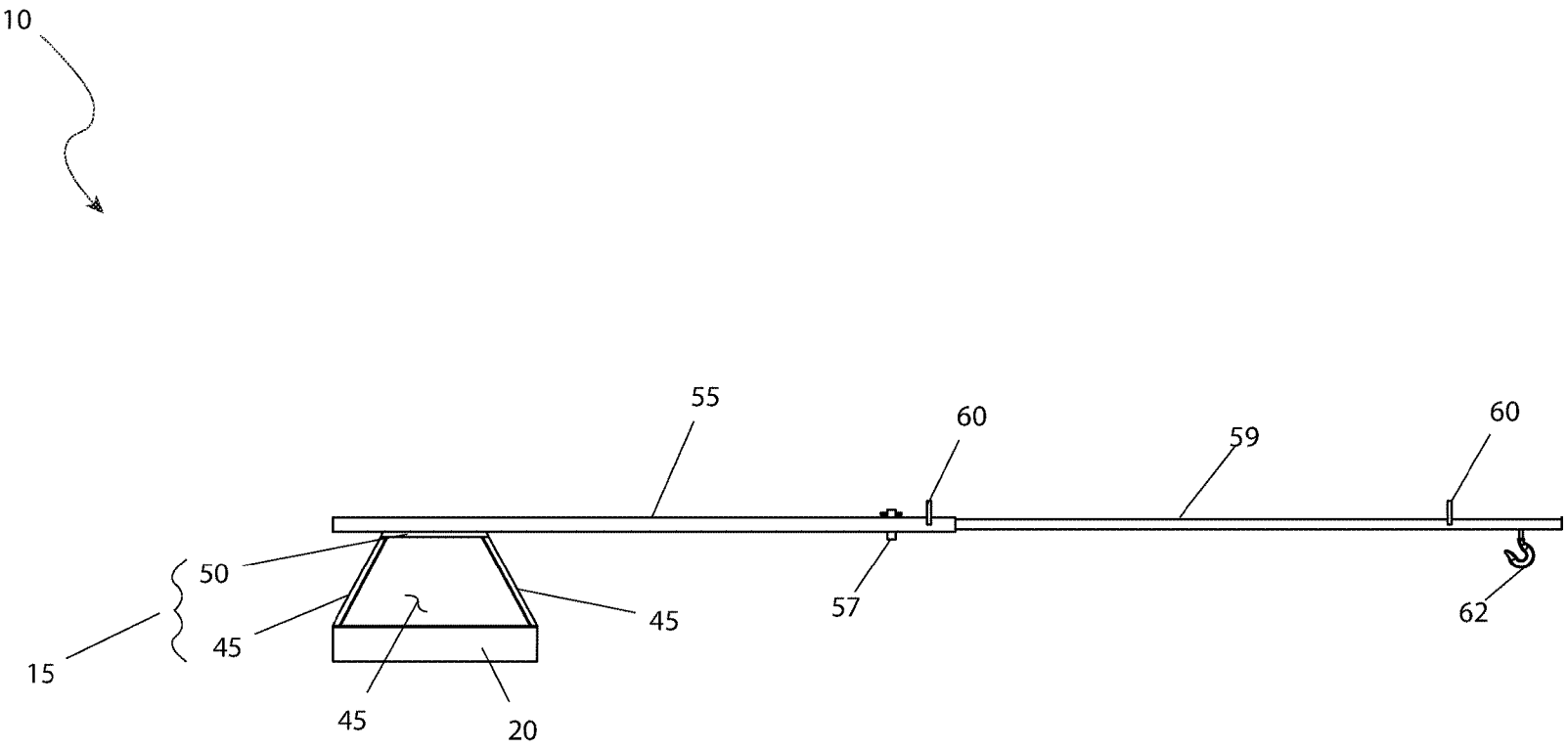
FIG. 2 is a side view of the load stabilization device 10 for forked lifting machines 40, according to the preferred embodiment of the present invention.

Referring next to FIG. 2, a side view of the device 10, according to the preferred embodiment of the present invention is depicted. This view discloses the length of a first longitudinal member 55 and a second longitudinal member 59 and the stabilizing properties afforded by the base assembly 15. The second longitudinal member 59 slidably engages the first longitudinal member 55 and is capable of being secured thereto via a securing pin 57 routed through aligned pairs of apertures 56. The first longitudinal member 55 and second longitudinal member 59 can each vary per specific application and the overall length of the base assembly 15 is not intended to be a limiting factor of the present invention. However, for purposes of illustration, it is envisioned that a typical length of adjustable nature between the first longitudinal member 55 and second longitudinal member 59 would be between twelve and twenty feet (12-20 ft.). This view discloses two (2) of the four (4) first restraining members 60, one (1) located adjacent the distal end of the located at the distal end of the first longitudinal member 55 and one (1) located adjacent a distal end of the second longitudinal member 59. In certain embodiments, a hook 62 is located on a distal end of the second longitudinal member 59 for grasping objects therewith. Alternately, such as hook 62 can be securely mounted to a lower surface of either side of either first restraining member 60 (i.e., the first restraining member 60 on the first longitudinal member 55 or second longitudinal member 59).

Figure 3:
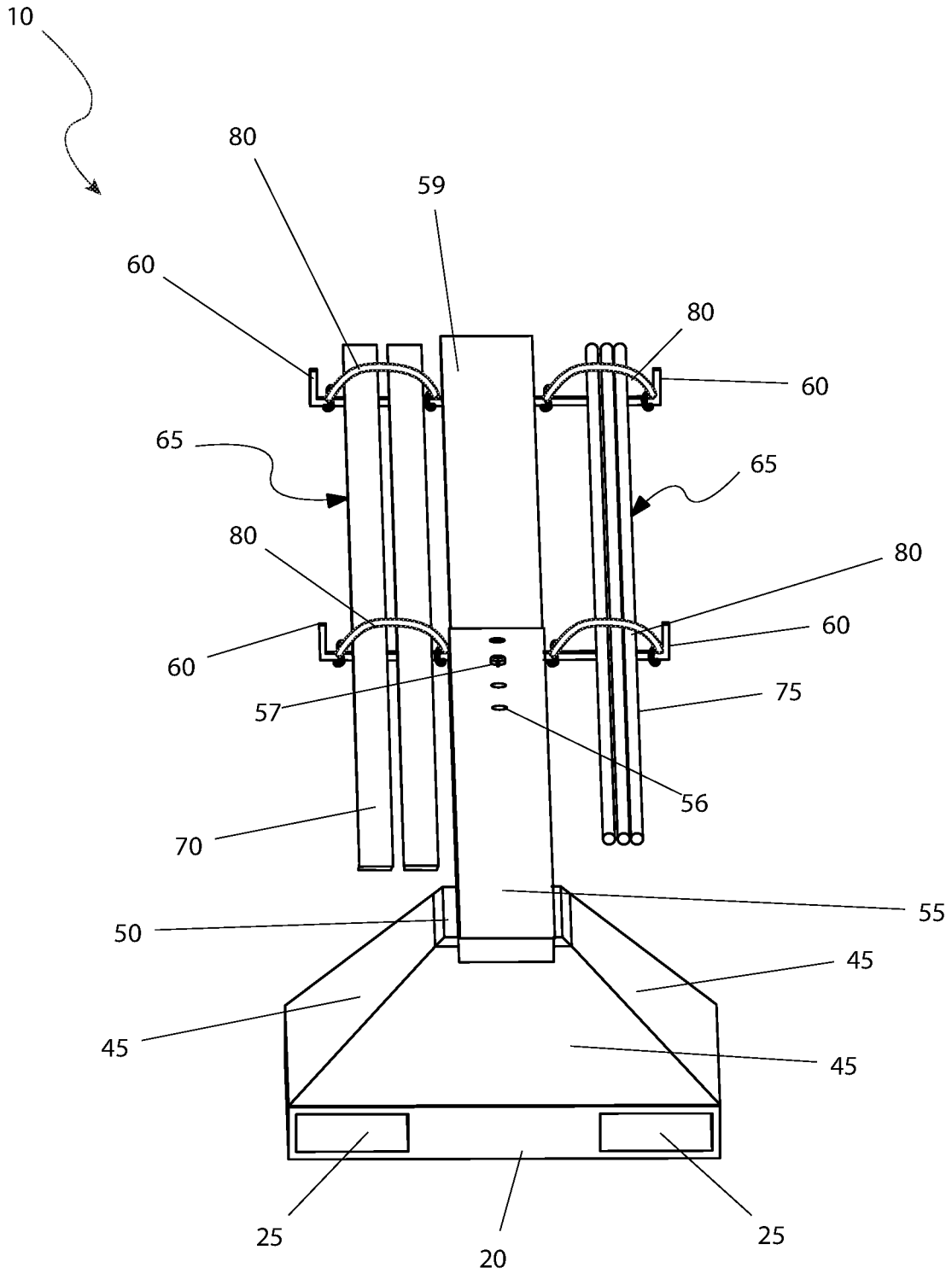
FIG. 3 is a perspective view of the load stabilization device 10 for forked lifting machines 40, according to the preferred embodiment of the present invention.

Referring now to FIG. 3, a perspective view of the device 10, according to the preferred embodiment of the present invention is shown. This view provides disclosure on the ability of the device 10 to carry, transport and support linear loads 65. The linear loads 65 are depicted as flat panels 70 such as roofing panels, siding panels, dimensional lumber or the like. Linear loads 65 may also be cylindrical objects 75 such as pipe, conduit, rebar, or the like. The first restraining members 60 as attached to the side surfaces of the longitudinal members 55, 59 serve as structural supports for the linear loads 65. To further aid in stability of the linear loads 65 during transport, lashing members 80, such as rope, ratcheting clamps, bungee cords, or the like, may be used to secure said linear loads 65 to the first restraining members 60. The first longitudinal member 55 is firmly secured to the upper panel 50, and in turn to the structural side panels 45 as well as the base platform 20. The fork receiving cavities 25 are visible on the outside edge of the base platform 20 and parallel with the first longitudinal member 55.

Figure 4:
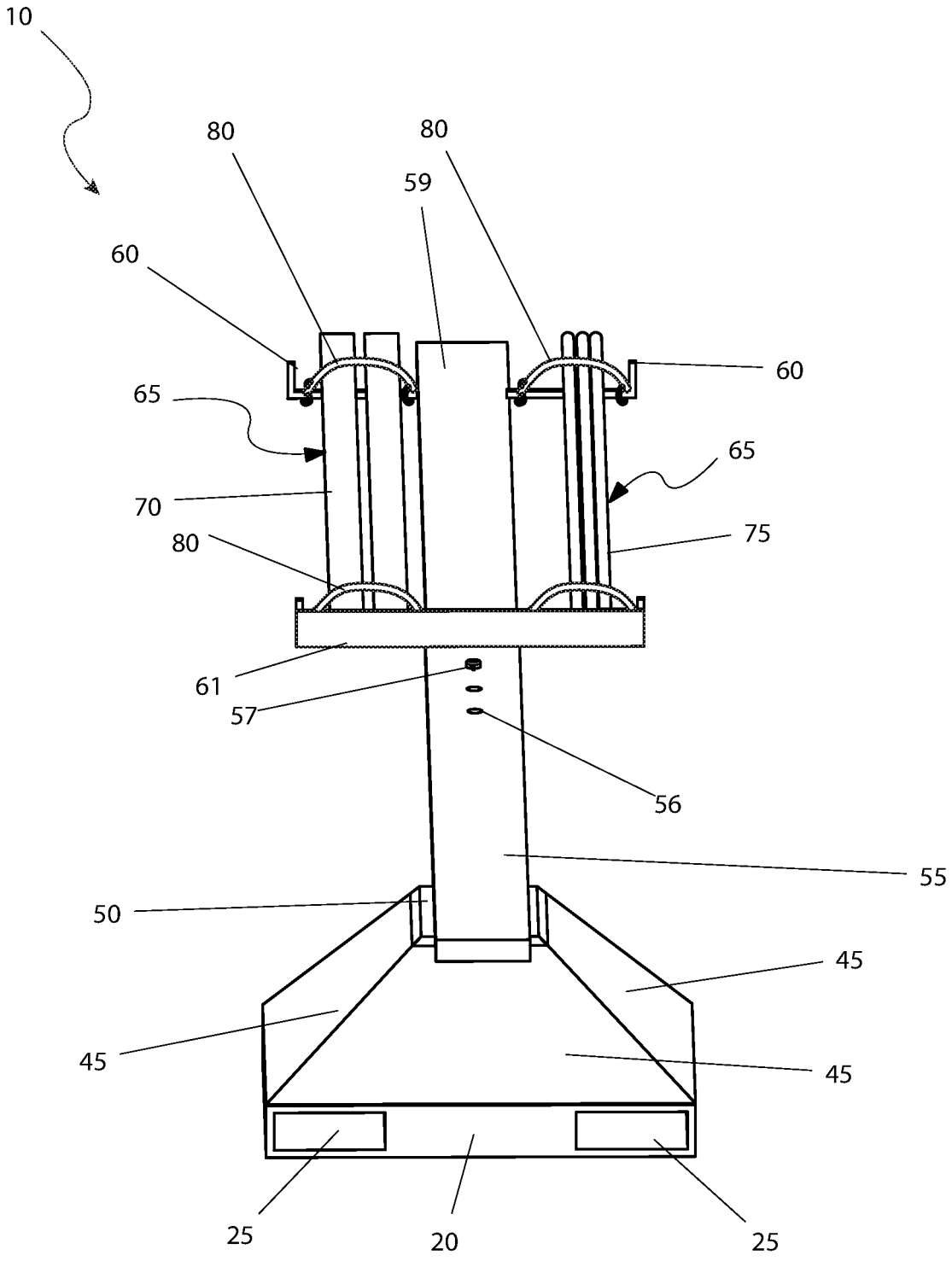
FIG. 4 is a perspective view of the load stabilization device 10 for forked lifting machines 40, according to an alternate embodiment of the present invention.

Referring now to FIG. 4, which illustrates an alternate embodiment in a similar view as that shown in FIG. 3. The first restraining members 60 located on the distal end of the first longitudinal member 55 are replaced with a single second restraining member 61. The second restraining member 61 is shaped like a shelf, with a bottom wall, a rear wall, and pair of side walls. The second restraining member 61 is affixed to the distal end of the first longitudinal member 55 with a strap or locking pin. The bottom wall engages the top of the first longitudinal member 55 and has the strap or locking pin engaging that with the first longitudinal member 55. The side walls function similar to how the first restraining walls 60 function in the preferred embodiment. The rear wall acts as a stop to gravitational travel of the linear loads 65 as the device 10 is raised or lowered.

Figure 5:
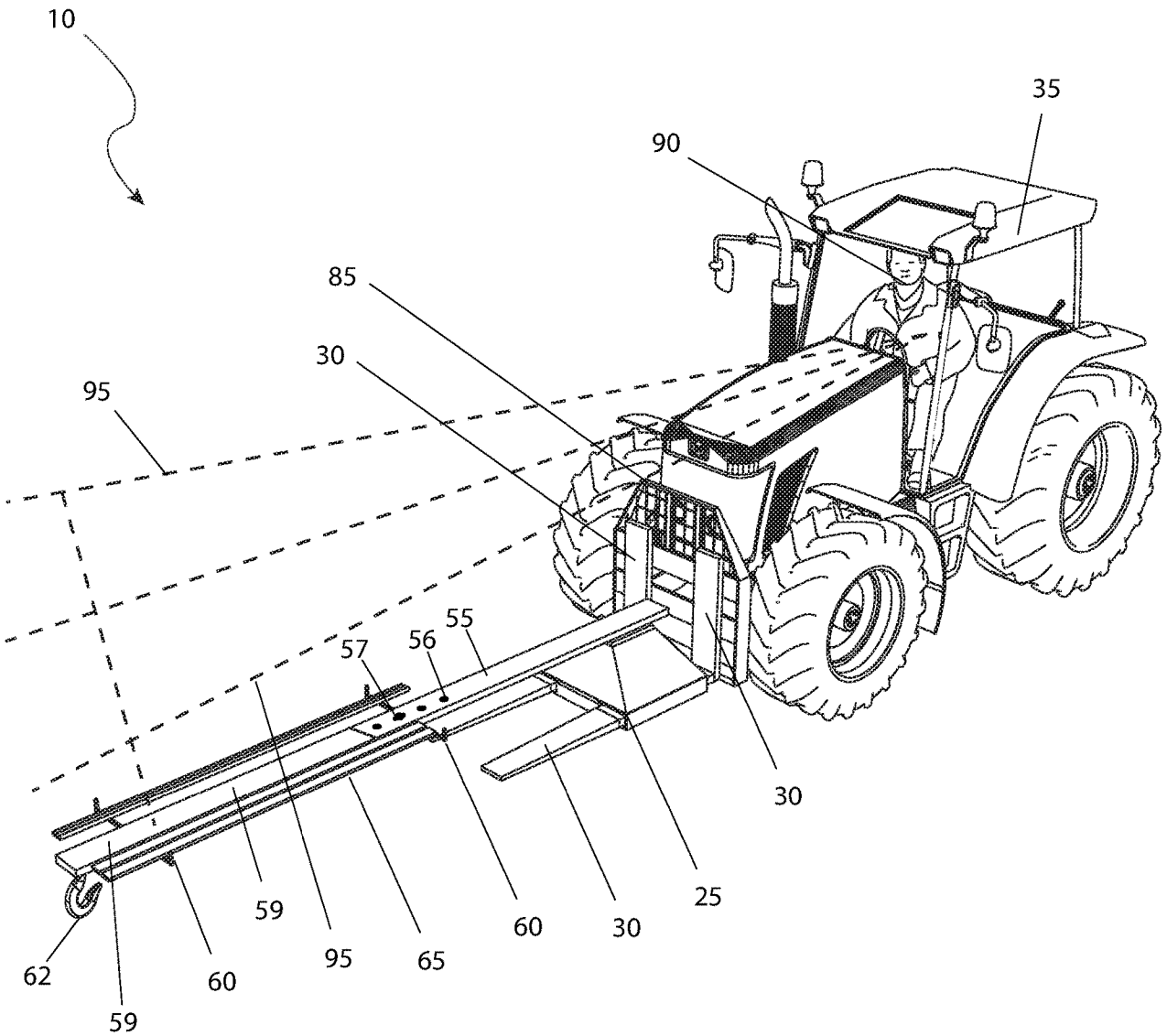
FIG. 5 is a perspective view of the load stabilization device 10 for forked lifting machines 40, shown in an installed state on a skid steer machine 35, according to the preferred embodiment of the present invention; and, FIG. 6 is a perspective view of the load stabilization device 10 shown in an installed and utilized state on a forked lifting device 40, according to the preferred embodiment of the present invention.

Referring next to FIG. 5, a perspective view of the device 10, shown in an installed state on a skid steer machine 35, according to the preferred embodiment of the present invention is disclosed. The skid steer machine 35 is equipped with a fork lift accessory 85, complete with forks 30. The forks 30 are positioned to engage the fork receiving cavities 25 of the device 10 as aforementioned described. A set of linear loads 65 are deployed upon the longitudinal member 55 and the first restraining members 60 (or first and second restraining members 60, 61 in the usage of the alternate embodiment). It is noted that the operator 90 of the skid steer machine 35 is afforded a field of view 95 that spans the length of the device 10 as well as the supported linear loads 65. The field of view 95 is easily accommodated and ergonomically comfortable when compared to a wide view should the linear loads 65 be carried across the forks 30 in a manner perpendicular to that shown. Additionally, the conventional method of carrying the linear loads 65 across the forks 30 in a perpendicular manner is less steady and more likely to result in load slippage and subsequent load spills.

Figure 6:
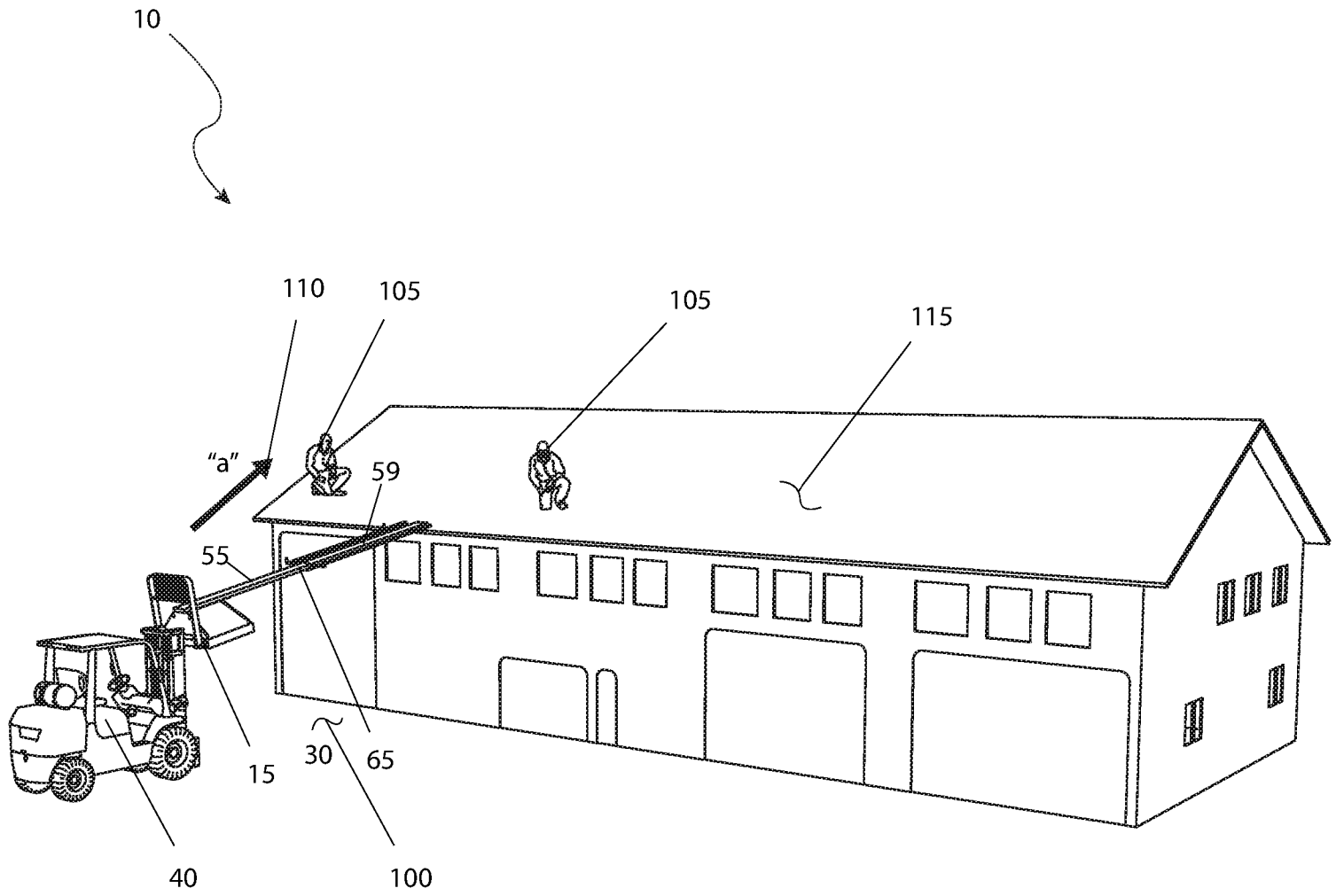

Referring to FIG. 6, a perspective view of the device 10, shown in an installed and utilized state on a forked lifting device 40, according to the preferred embodiment of the present invention is depicted. The device 10 is used upon the forks 30 of the forked lifting device 40 by engagement of the base assembly 15 in a manner similar to that of the skid steer machine 35 (as shown in FIG. 5). The device 10 is used to hold and transport said linear loads 65 to an unloading point 100. The forks 30 of the forked lifting device 40 is then used to raise and, if necessary, angle the device 10 and carried linear loads 65 to a point where user 105 may slide said linear loads 65 along a sliding path "a" 110 to an elevated work location 115. This usage is simple and in sharp contrast to typical methods where the linear loads 65 may have to be transported to an intermediate position where further manual manipulation is required. As the linear loads 65 is handled less, and is not lifted manually, and is slid along the sliding path "a" 110, work effort is reduced and safety for the users 105 is enhanced. After use of the device 10, it may be removed, allowing the skid steer machine 35 (as shown in FIG. 5) and the forked lifting device 40 to return to other conventional tasks.

2. OPERATION OF THE PREFERRED EMBODIMENT

The preferred embodiment of the present invention can be utilized by the common user in a simple and effortless manner with little or no training. It is envisioned that the device 10 would be constructed in general accordance with FIG. 1 through FIG. 3, FIG. 5, and FIG. 6, with an alternate embodiment illustrated in FIG. 4. The user would procure the device 10 from conventional procurement channels such as equipment manufacturers, fabrication houses, rental supply houses, material handling distributors, or the like. Particular attention would be paid to the overall length of the longitudinal members 55, 59 with respect to the specific application the device 10 is to be used in.

After procurement and prior to utilization, the device 10 would be prepared in the following manner: the device 10 would be positioned on a suitable horizontal surface such as grade, and the skid steer machine 35 or forked lifting device 40 would be driven up to it; with manipulation of the forks 30 with respect to spacing, approach angle, elevation and the like, the forks 30 would be inserted through the fork receiving cavities 25 of the base platform 20; and the forks 30 would be angled up slightly to lift the device 10 for transport, and the second longitudinal member 59 will be secured at a desired distance to the first longitudinal member 55 with the securing pin 57.

During utilization of the device 10, the following procedure would be initiated: the skid steer machine 35 of forked lifting device 40 would be driven to a loading point whereupon linear loads 65 such as flat panels 70 and/or cylindrical objects 75 would be loaded upon the first restraining members 60 (or alternately, in the first and second restraining members 60, 61 in the usage of the alternate embodiment); it is envisioned that said loading would be equal on both sides of the longitudinal member 55, 59 to help distribute the load; if necessary, lashing members 80 would be used to secure the linear loads 65 to the device 10; if necessary, the linear load 65 or any other load can be handled with the hook 62; the skid steer machine 35 or forked lifting device 40 would be driven to an unloading point 100 whereupon the forks 30 would be raised such that the distal end of the linear loads 65 can be accessed by users 105 at an elevated work location 115; said linear loads 65 would then be unloaded by sliding them along the sliding path "a" 110.

After use of the device 10, it is lowered back to grade where the above process may be repeated as needed. If no longer needed, the skid steer machine 35 or forked lifting device 40 may be driven away from the device 10 until needed again at a future time. The skid steer machine 35 or forked lifting device 40 may return to conventional duties and tasks.

The features of the of the device 10 are envisioned to be beneficial in the following situations/applications: at building construction sites, major repair or renovation projects, areas where large amounts of linear loads 65 must be transported, lifted, or utilized, and areas where methods of material handling such as cranes are not available, practical or prohibited.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A load stabilization device, comprising:

a base assembly having a base platform with a pair of fork receiving cavities capable of receiving a pair of forks, the base assembly is disposed at a proximal end of the load stabilization device;

a first longitudinal member extending away from the base assembly from which a pair of first restraining members are placed;

a second longitudinal member linearly extending away from the first longitudinal member from which the pair of first restraining members are placed, the second longitudinal member slidably engages the first longitudinal member and is secured thereto;

a plurality of linear loads carried, transported and supported by the load stabilization device, the pair of first restraining members are attached to the side surfaces of the longitudinal members to serve as structural support for the linear loads; and a set of four structural side panels forming a pyramid shape which centers an upper panel at its midpoint to ensure a central based center of gravity between the pair of fork receiving cavities;

wherein the pair of forks extending through the pair of fork receiving cavities of the base platform and into the base assembly; and wherein the second longitudinal member directly slidably engages the first longitudinal member via a securing pin routed through an aligned pairs of apertures.

2. The load stabilization device according to claim 1, wherein the first longitudinal member is between twelve feet to twenty feet.

3. The load stabilization device according to claim 1, wherein the second longitudinal member is between twelve feet to twenty feet.

4. The load stabilization device according to claim 1, further comprising a hook located on a distal end of the second longitudinal member for grasping objects therewith.

5. The load stabilization device according to claim 4, wherein the hook is located on a distal end of the first longitudinal member for grasping objects therewith.

6. The load stabilization device according to claim 1, wherein the linear loads are a plurality of flat panels selected from the group consisting of a plurality of roofing panels, a plurality of siding panels, and a plurality of dimensional lumber.

7. The load stabilization device according to claim 1, wherein the linear loads are a plurality of cylindrical objects selected from the group consisting of a plurality of pipe, a plurality of conduit, and a plurality of rebar.

8. The load stabilization device according to claim 1, further comprising a plurality of flashing members used to secure the linear loads to the first restraining members.

9. The load stabilization device according to claim 8, wherein the lashing members are selected from the group consisting of a plurality of ropes, a plurality of ratcheting clamps, or a plurality of bungee cords.

10. The load stabilization device according to claim 1, wherein the load stabilization device is made of steel for strength.

11. The load stabilization device according to claim 1, wherein the load stabilization device has a protective paint finish to prevent corrosion.

12. The load stabilization device according to claim 1, wherein the load stabilization device is installed on a skid steer machine.

13. The load stabilization device according to claim 1, wherein the load stabilization device is installed on a forked lifting device.

* * * * *